US012202660B1

(12) United States Patent
Wang

(10) Patent No.: US 12,202,660 B1
(45) Date of Patent: Jan. 21, 2025

(54) AIRTIGHT CONTAINER WITH A UNIDIRECTIONAL EXHAUST VALVE

(71) Applicant: Jui-Te Wang, Taichung (TW)

(72) Inventor: Jui-Te Wang, Taichung (TW)

( * ) Notice: Subject to any disclaimer, the term of this patent is extended or adjusted under 35 U.S.C. 154(b) by 42 days.

(21) Appl. No.: 18/225,154

(22) Filed: Jul. 23, 2023

(51) Int. Cl.
*B65D 51/16* (2006.01)

(52) U.S. Cl.
CPC ..... *B65D 51/1683* (2013.01); *B65D 2205/00* (2013.01)

(58) Field of Classification Search
CPC ..... B65D 51/1683; B65D 2205/00; B65D 51/2892; B65D 47/2018; B65D 47/205; B65D 47/2056; B65D 47/2062; B65D 47/2068; B65D 47/2081; B65D 47/2093; B65D 47/24; B65D 47/241; B65D 47/244; B65D 47/245; B65D 47/248; B65D 47/26; B65D 47/268; B65D 47/30; B65D 47/38; B65D 47/44; B65D 49/02
See application file for complete search history.

(56) References Cited

U.S. PATENT DOCUMENTS 5,697,510 A * 12/1997 Wang ..... B65D 51/1683 215/310
6,044,756 A * 4/2000 Chang ..... B65B 31/047 99/454
6,644,489 B2 * 11/2003 Chang ..... B65D 81/2038 215/311
6,789,690 B2 * 9/2004 Nieh ..... B65D 81/2015 220/203.11
7,048,136 B2 * 5/2006 Havens ..... B65D 51/1644 222/509
2015/0136770 A1 * 5/2015 Wang ..... A47J 47/02 220/203.22

* cited by examiner

*Primary Examiner* — Kareen K Thomas

(57) ABSTRACT

An airtight container with a unidirectional exhaust valve is provided. The airtight container comprises: a container, having a storage space; a cover, covered and sleeved on the top of the container; wherein the cover has an outlet groove and a control groove, the outlet groove has an outlet hole, and the control groove has a through hole, the outlet hole and the through hole are communicated with the storage space correspondingly; an elastic outlet unit, elastically abutted on the outlet groove of the cover; and a control unit, having a control member movably arranged at the control groove of the cover. When presses the control member, the through hole of the control groove forms an open state and communicates with the storage space of the container.

7 Claims, 7 Drawing Sheets

AIRTIGHT CONTAINER WITH A UNIDIRECTIONAL EXHAUST VALVE

FIELD OF THE DISCLOSURE

The present disclosure is related to the technical field related to airtight containers, in particular to a control unit provided on the cover of the container, which facilitates the assembly and disassembly of the cover and the container.

BACKGROUND OF THE DISCLOSURE

Conventional moisture-proof containers can store food and effectively isolate the air from outside of the container, so as to prevent food from getting moisture. As disclosed in TW M384166, which is a moisture-proof container composed of a container and a cover. The container is provided with storage space with an opening, and the cover can close the opening of the container. In detail, the wall surface of the storage space of the container and the cover is coated with a layer of natural lacquer, so that the container and the cover can be adjacent to the storage space with a layer of film. The active Laccase enzyme contained in the natural lacquer is used to absorb the moisture in the storage space and continuously dry the storage space, so that the food can be prevented from getting moisture.

However, the active Laccase enzyme film coating of the conventional moisture-proof container is coated on the inner side of the container and cover, which results in a bad effect on the quality of the food when the food touches the film. Therefore, improving the lack of conventional moisture-proof containers is the primary research focus of the present disclosure.

SUMMARY OF THE DISCLOSURE

The present disclosure provides an airtight container with a unidirectional exhaust valve, particularly a container with an airtight effect. By pressing the control member of the cover, the cover is easy to open or close, so as to achieve the purpose of easy assembly or disassembly.

The present disclosure provides an airtight container with a unidirectional exhaust valve. By providing an elastic outlet unit on the cover, the fermented gas of the food in the container can be discharged to achieve the purpose of preserving food.

In order to achieve the above-mentioned objective, the present disclosure provides an airtight container with a unidirectional exhaust valve. The airtight container comprises: a container, having a storage space; a cover, covered and sleeved on the top of the container; wherein the cover has an outlet groove and a control groove, the outlet groove has an outlet hole, and the control groove has a through hole, the outlet hole and the through hole are communicated with the storage space correspondingly; an elastic outlet unit, elastically abutted on the outlet groove of the cover; and a control unit, having a control member movably arranged at the control groove of the cover. When presses the control member, the through hole of the control groove forms an open state and communicates with the storage space of the container.

In certain embodiments, the elastic outlet unit has a first connecting portion, and the first connecting portion has a ring rib part and a hook rib part on the surface and the end, and the first connecting portion of the elastic outlet unit is connected to the outlet hole of the outlet groove and is limited by the stop ring.

In certain embodiments, the control unit has a fastener member and an elastic member, and the control member has an axis part; wherein the fastener member and the elastic member are detachable and assembled on the axis part, and the fastener member closes the through hole of the control groove when the axis part inserts the control groove from outside of the cover.

In certain embodiments, the surface of the axis part of the control member has a recess. When the control member is pushed, the elastic member will be pushed, and the axis part of the control member protrudes from the through hole of the control groove to the inner side of the cover, so that the fastener member of the through hole of the control groove forms an open state. Therefore, external air is allowed to enter the storage space of the container from the through hole of the control groove through the recess of the axis part of the control member, and a communication state is formed.

In certain embodiments, the elastic outlet unit is disposed on the outlet groove and is limited by the stop ring. Further, the elastic outlet unit has a second joint surface extending outward from the first connecting portion, and the second joint surface and the first joint surface of the outlet groove complement each other, the second joint surface has a convex ring part near the first connecting portion. The second joint surface has a convex ring part near the first connecting portion, the first connecting portion has a ring rib part on the surface, and a hook rib part at the end.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
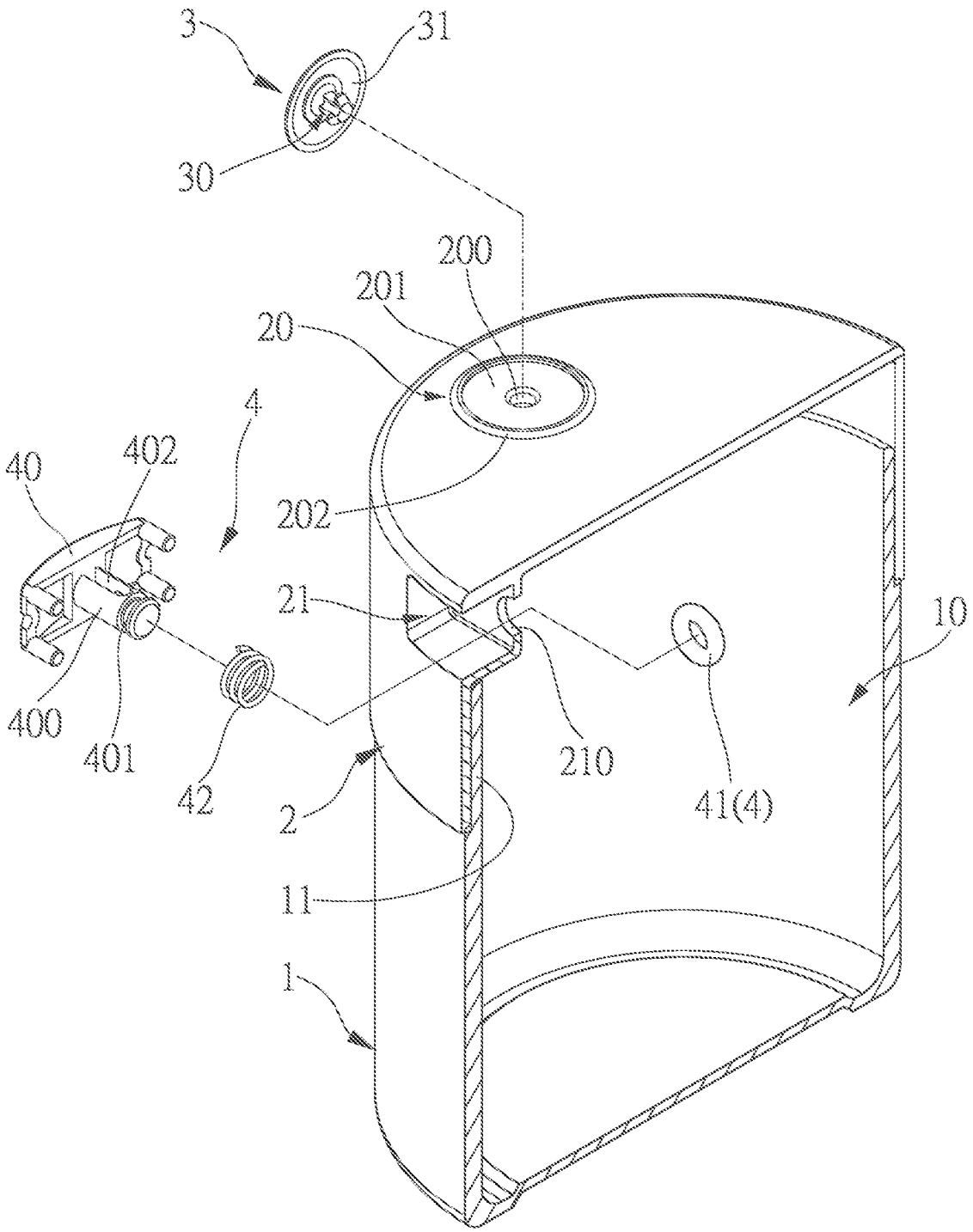
FIG. 1 is an exploded perspective schematic view of the present disclosure.
Figure 2:
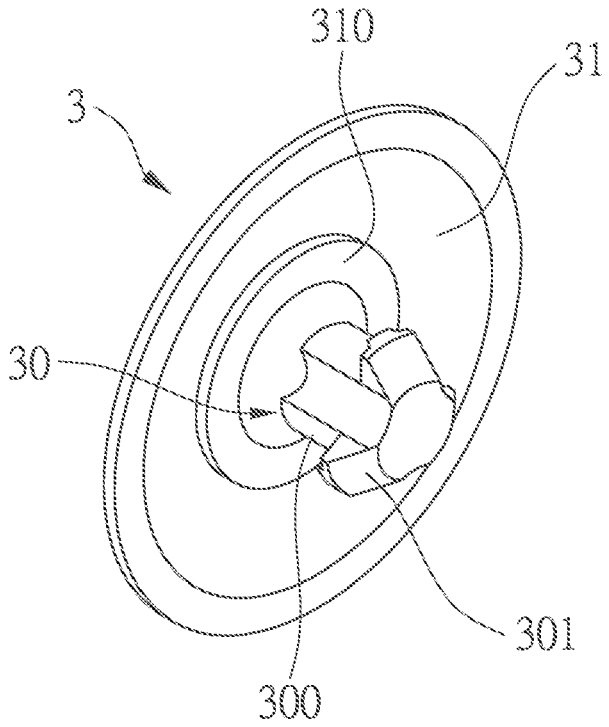
FIG. 2 is an enlarged schematic view of the elastic outlet unit of the present disclosure.
Figure 3:
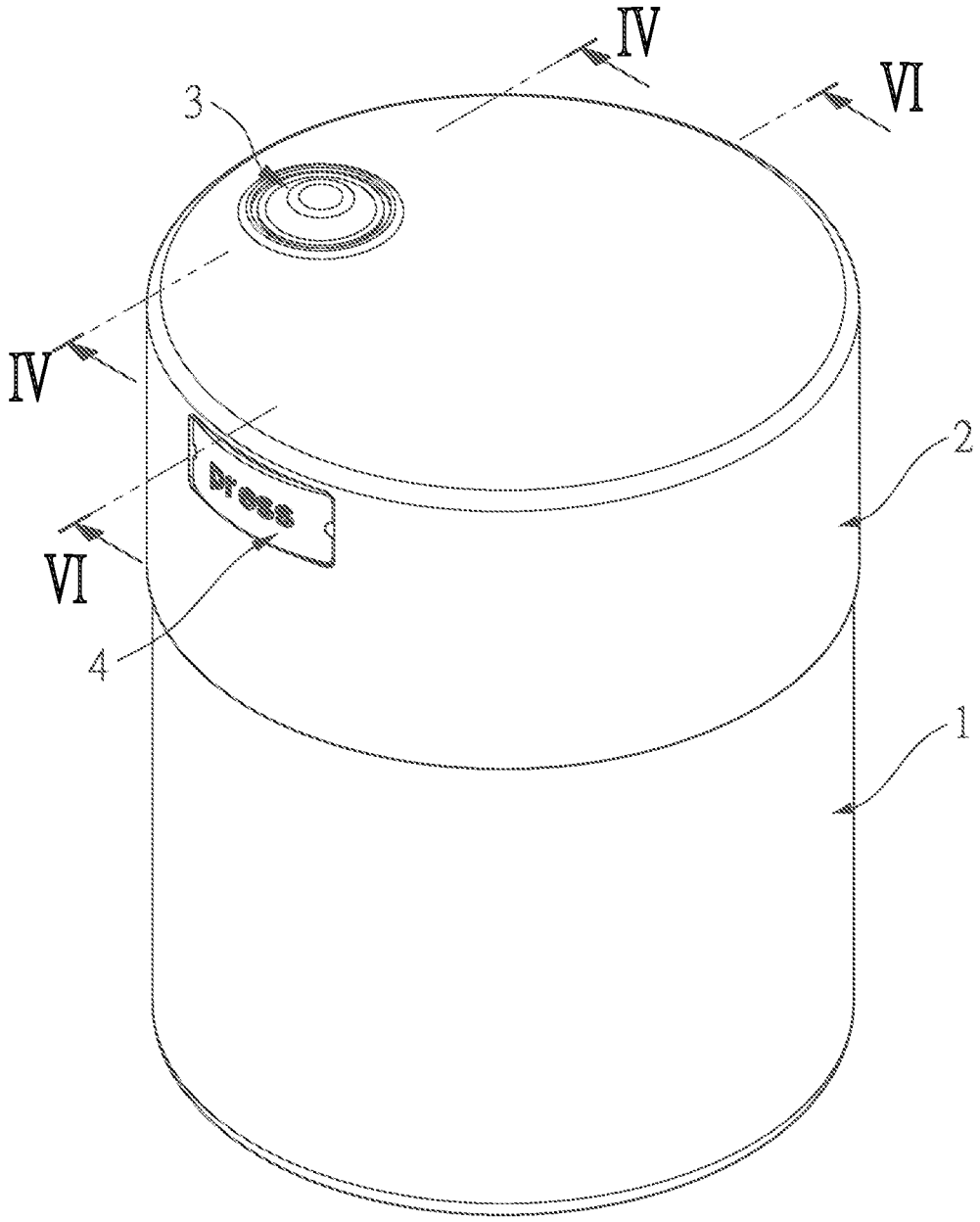
FIG. 3 is an assembled perspective schematic view of the present disclosure.
Figure 4:
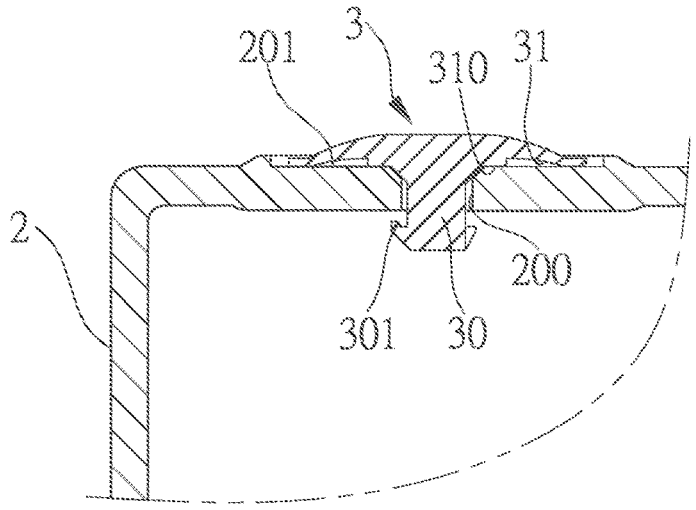
FIG. 4 is a sectional schematic view of line IV-IV of FIG. 3 of the present disclosure.

The construction and method of operation of the present disclosure, together with additional objects and advantages thereof, will be best understood from the following description of one or more embodiment(s) when read in connection with the accompanying drawings. Firstly, referring to FIG. 1 to FIG. 8. The present disclosure provides an airtight container with a unidirectional exhaust valve. The airtight container comprises a container 1, a cover 2, an elastic outlet unit 3, and a control unit 4.

The container 1 has a storage space 10 and a joint portion 11 at the top. The storage space 10 is used for accommodating food.

The cover 2 is tight sleeved on the joint portion 11 of the container 1. The cover 2 has an outlet groove 20 and a control groove 21. In detail, the outlet groove 20 is located at the top of the cover 2. The outlet groove 20 has an outlet hole 200, and a first joint surface 201 extending outward from the outlet hole 200. The outlet hole 200 passes through the cover 2 and communicates with the storage space 10 of the container 1. A stop ring 202 is convexly encircled the first joint surface 201. The control groove 21 is located at the side of the cover 2. The control groove 21 has a through hole 210, and the through hole 210 passes through the cover 2 and is communicated with the storage space 10 of the container 1.

The elastic outlet unit 3 has a second joint surface extending outward from the first connecting portion, the first connecting portion 30 has a ring rib part 300 on the surface and a hook rib part 301 at the end. The second joint surface 31 of the first connecting portion 30 and the first joint surface 201 of the outlet groove 20 complement each other. The second joint surface 31 has a convex ring part 310 near the first connecting portion 30. When the elastic outlet unit 3 is fitted in the outlet groove 20, the stop ring 202 of the outlet groove 20 limits the elastic outlet unit 3 at the position. When the first connecting portion 30 of the elastic outlet unit 3 is connected with the outlet hole 200, the convex ring part 310 of the second joint surface 31 is pressed against the outlet hole 200, and the ring rib part 300 and the hook rib part 301 of the first connecting portion 30 allow the elastic outlet unit 3 more fittingly attached to the outlet groove 20.

The control unit 4 has a control member 40, a fastener member 41 and an elastic member 42. The control member 40 is integral molding with an axis part 400, the axis part 400 has a fitting part 401 and a recess 402, and the fitting part 401 accommodates the fastener member.

The fastener member 41 stops the through hole 210 of the control groove 21 from the inner side of the cover 2. The elastic member 42 is assembled on the axis part 400 and the axis part 400 is inserted into the control groove 21 from the outer side of the cover 2, the fastener member 41 limits the through hole 210 of the control groove 21 and stop the through hole 210. In addition, the through hole 210 of the control groove 21 is not communicated with the storage space 10 of the container 1, so that the storage space 10 of the container 1 is sealed and moisture-proof. In one embodiment, the elastic member 42 is a telescopic spring.

Moreover, the use of the airtight container with a unidirectional exhaust valve of the present disclosure is further described.

Figure 7:
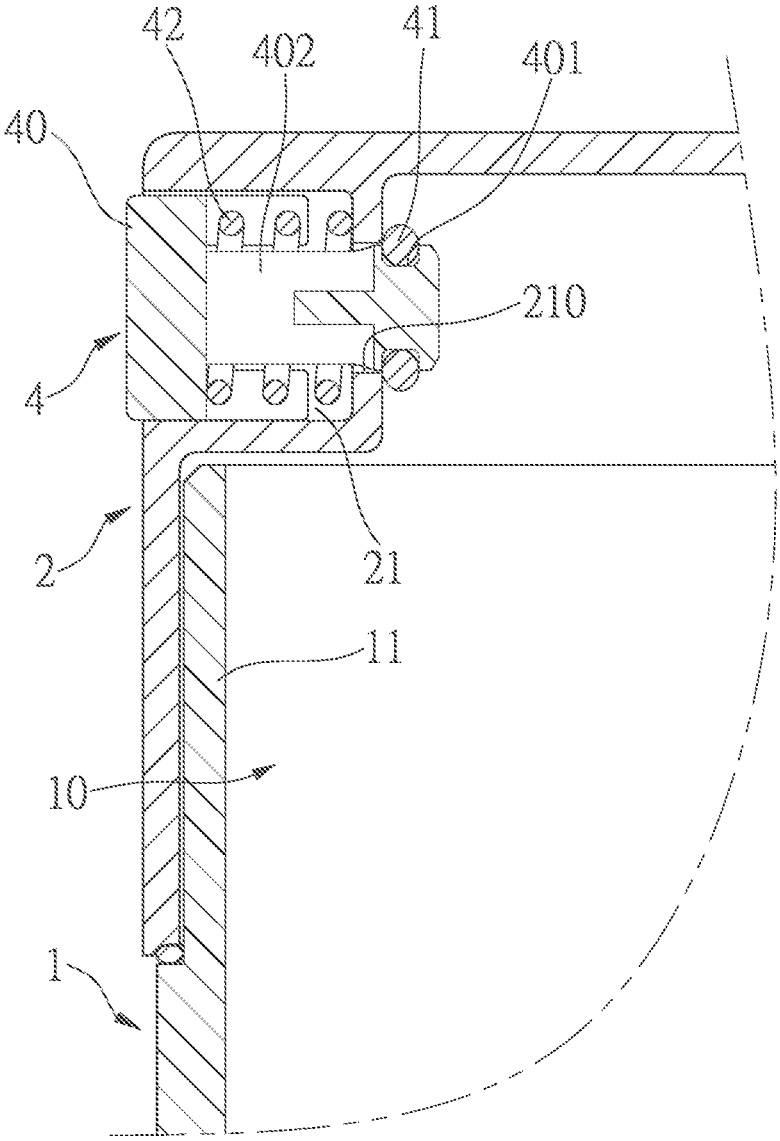
FIG. 7 is an enlarged sectional schematic view of the control unit of the present disclosure.
Figure 8:
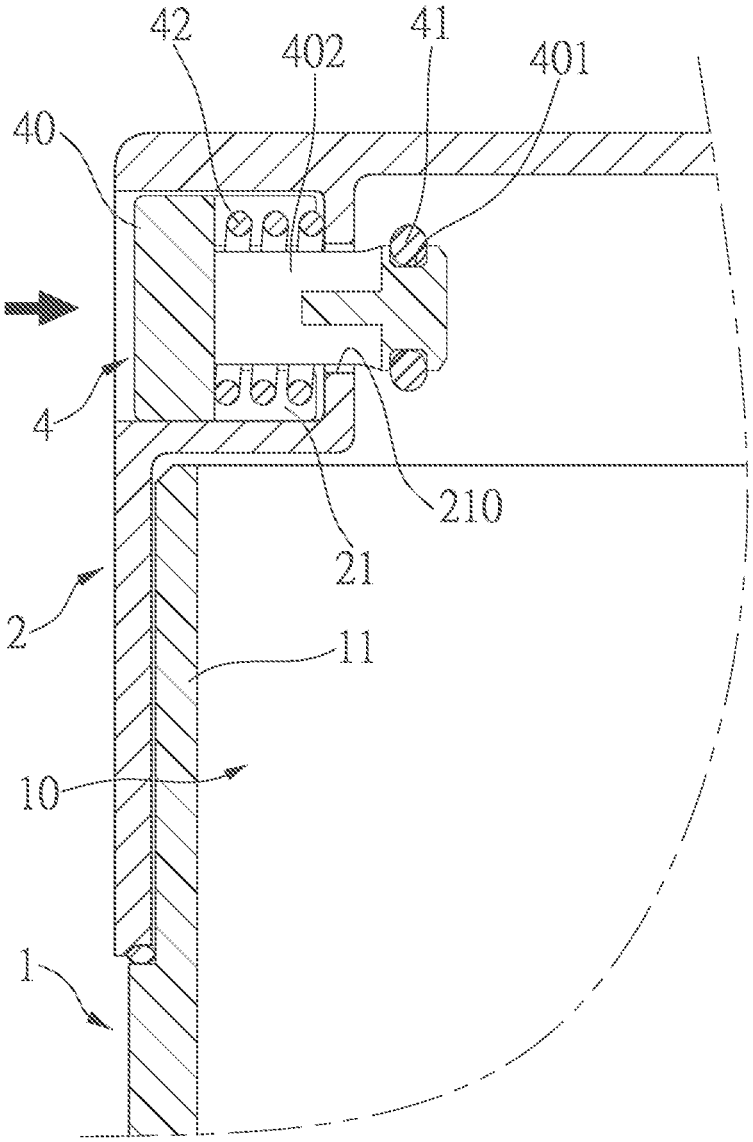
FIG. 8 is a schematic view of the movement according to FIG. 7 of the present disclosure.

The description can be read in conjunction with FIG. 7 and FIG. 8. When the cover 2 is to be removed, press the control member 40 of the control unit 4, so that the control member 40 pushes the elastic member 42 and forms a compressed state of the elastic member 42. The axis part 400 of the control member 40 inserts the inner side of the cover 2 from the through hole 210 of the control groove 21, the fastener member 41 of the axis part 400 of the control member 40 is away from the through hole 210 of the control groove 21, so that the through hole 210 forms an open state and communicates with the storage space 10 of the container 1. Meanwhile, external air is allowed to enter the storage space 10 of the container 1 from the recess 402 of the axis part 400 of the control member 400, and through the through hole 210 of the control groove 21. Further, the cover 2 can be removed.

Conversely, when the cover 2 is covered on the container 1, press the control member 40 of the control unit 4. In the same way, the cover 2 can be easily sleeved and covered on the joint portion 11 of the container 1 due to the external air can pass the through hole 210 of the control groove 21 through the recess 402 of the axis part 400 of the control member 40, and communicates with the storage space 10 of the container 1. When the control member 40 is released, the control member 40 forms a rebound action due to the elastic recovery of the elastic member 42, the fastener member 41 of the axis part 400 of the control member 40 stops the through hole 21 of the control groove 21, so that the external air cannot communicate with the storage space 10 of the container 1. Under the principle of atmospheric pressure, the cover 2 is tightly sleeved on the container 1 and cannot be removed, so that the storage space 10 of the container 1 achieves airtight and moisture-proof effects.

Figure 5:
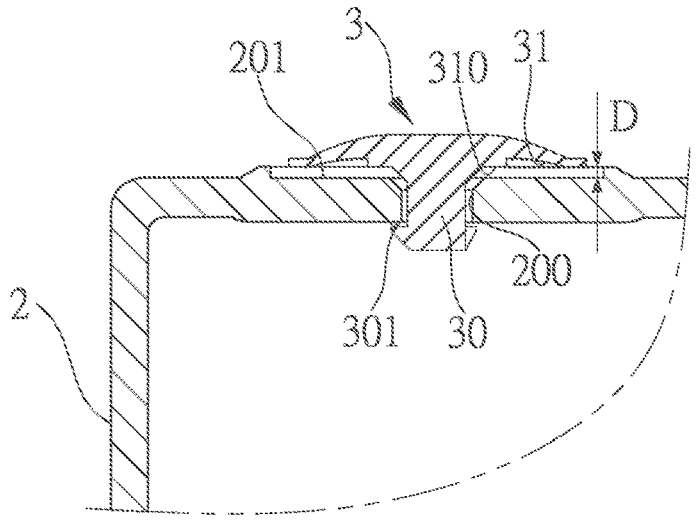
FIG. 5 is a sectional schematic view of the movement according to FIG. 4 of the present disclosure.
Figure 6:
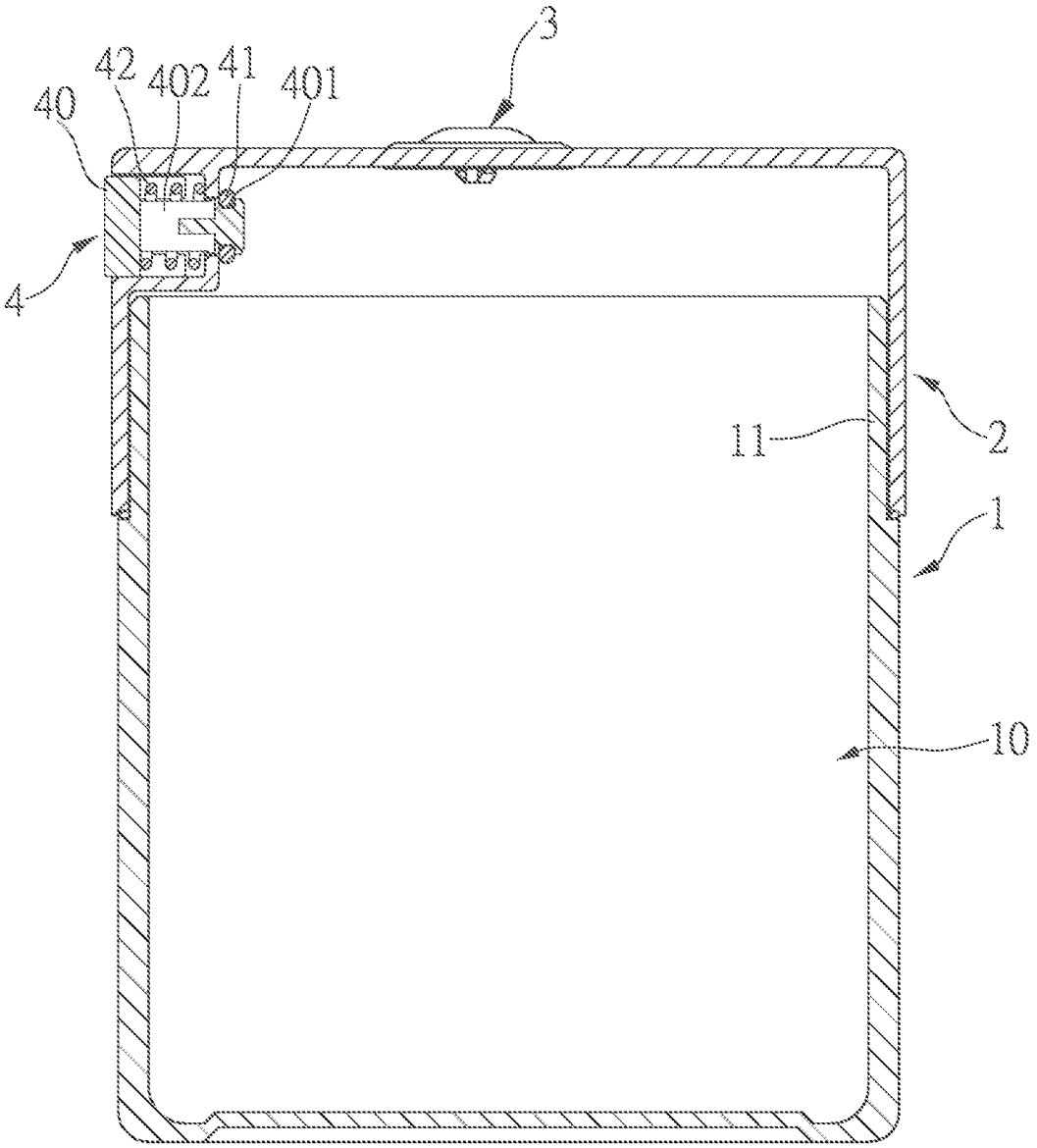
FIG. 6 is a sectional schematic view of line VI-VI of FIG. 3 of the present disclosure.

Further, when the pressure of the food fermentation gas in the storage space 10 of the container 1 increases, the gas in the storage space 10 of the container 1 will be discharged from an air slit D between the elastic outlet unit 3 and the outlet groove 20 (as shown in FIG. 5), the food will not deteriorate due to the excessive air pressure in the storage space 10 of the container 1.

In summary, the airtight container with a unidirectional exhaust valve of the present disclosure can easily achieve the effect of assembling or disassembling the cover 2 and the container 1 by the actions of pressing or releasing the control member 40 of the control unit 4. Further, when the pressure of the food fermentation gas in the storage space 10 of the container 1 increases, the gas can be discharged from an air slit D between the elastic outlet unit 3 and the outlet groove 20. Therefore, the purpose of preserving food can be achieved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching and will be suggested to persons skilled in the art and are to be included within the spirit and purview of the present disclosure and scope of the appended claims.

What is claimed is:

1. An airtight container with a unidirectional exhaust valve, comprising:

a container, having a storage space;

a cover, covered and sleeved on a top of the container; wherein the cover has an outlet groove and a control groove, the outlet groove has an outlet hole, and the control groove has a through hole, the outlet hole and the through hole are communicated with the storage space correspondingly;

an elastic outlet unit, elastically abutted on the outlet groove of the cover; and a control unit, having a control member; wherein the control member is movably arranged at the control groove of the cover, the through hole of the control groove communicates with the storage space of the container by pressing the control member.

2. The airtight container with a unidirectional exhaust valve according to claim 1, wherein the outlet groove is disposed on a top of the cover and the control groove is disposed on a side of the cover; wherein the outlet groove has a first joint surface, and a stop ring convexly encircled the first joint surface.

3. The airtight container with a unidirectional exhaust valve according to claim 2, wherein the elastic outlet unit has a first connecting portion, and the first connecting portion has a ring rib part and a hook rib part on a surface and an end of the first connecting portion respectively, and the first connecting portion of the elastic outlet unit is connected to the outlet hole of the outlet groove and is limited by the stop ring.

4. The airtight container having an unidirectional exhaust valve according to claim 3, wherein the elastic outlet unit has a second joint surface extending outward from the first connecting portion, and the second joint surface and the first joint surface of the outlet groove are complemented each other, the second joint surface has a convex ring part near the first connecting portion.

5. The airtight container with a unidirectional exhaust valve according to claim 1, wherein the control unit has a fastener member and an elastic member, and the control member has an axis part; wherein the fastener member and the elastic member are detachably assembled on the axis part, and the fastener member closes the through hole of the control groove when the axis part inserts the control groove from outside of the cover.

6. The airtight container with a unidirectional exhaust valve according to claim 5, wherein the axis part of the control member has a fitting part on a surface of the axis part for accommodating the fastener member.

7. The airtight container with a unidirectional exhaust valve according to claim 5, wherein the axis part of the control member has a recess; wherein, by pressing the control member, the axis part inserts into an inner side of the cover from the through hole of the control groove, the fastener member moves away from the through hole of the control groove, so that the through hole communicates with the storage space, and allows external air entering the storage space of the container from the through hole of the control groove through the recess of the axis part of the control member.

* * * * *